United States Patent [19]

Cama

[11] Patent Number: 4,921,444

[45] Date of Patent: May 1, 1990

[54] ELECTRIC PLUG ORGANIZER

[75] Inventor: Christopher C. Cama, East Northport, N.Y.

[73] Assignee: C.C.C. Trading, Inc., East Northport, N.Y.

[21] Appl. No.: 256,734

[22] Filed: Oct. 12, 1988

[51] Int. Cl.[5] ..... H01R 13/60

[52] U.S. Cl. ..... 439/528

[58] Field of Search ..... 439/501, 528, 529, 590, 439/373, 536, 542; 174/66, 67; 248/316, 314

[56] References Cited

U.S. PATENT DOCUMENTS

| | | | |
|---|---|---|---|
| D. 275,175 | 8/1984 | Rolli, Jr. | D8/356 |
| 2,084,953 | 6/1937 | Gibson | 247/23 |
| 2,728,894 | 12/1955 | Peters | 339/44 |
| 2,845,245 | 7/1958 | Gray et al. | 248/314 |
| 2,943,138 | 6/1960 | Reager | 174/66 |
| 3,113,996 | 12/1963 | Sanford | 174/67 |
| 3,331,915 | 7/1967 | Lucci | 174/66 |
| 3,722,843 | 3/1973 | Enckler | 248/300 |
| 4,285,486 | 8/1981 | Von Osten et al. | 248/316 B |
| 4,293,173 | 10/1981 | Tricca | 339/38 |
| 4,335,863 | 6/1982 | Rapps | 248/316 D |
| 4,339,045 | 7/1982 | Bodin | 211/13 |
| 4,662,697 | 5/1987 | Moses | 174/67 X |
| 4,702,709 | 10/1987 | Santilli | 439/144 |
| 4,772,220 | 9/1988 | Hallier et al. | 439/528 |

FOREIGN PATENT DOCUMENTS

| | | |
|---|---|---|
| 78595 | 5/1951 | Norway . |
| 246366 | 9/1947 | Switzerland . |

OTHER PUBLICATIONS

"Hide That Cord" advertisement—Cosmo's Boutique—undated.

*Primary Examiner*—Eugene F. Desmond
*Attorney, Agent, or Firm*—Mark P. Stone

[57] ABSTRACT

An electric plug organizer includes a holder which surrounds the periphery of an electric plug for securely retaining the plug in a storage position. The holder is formed from a resilient material and is mounted near an electrical outlet. A longitudinal slot extending through one sidewall of the holder enables the holder to selectively receive a standard size two prong plug, or in the alternative, the holder may be expanded to receive a larger three prong plug. The electric plug organizer may include a receptacle adjacent to the holder for storing electrical cord, and may further include a protective outlet cover for insertion into an exposed electrical outlet when a plug is stored in the holder. The holder may be formed in varying dimensions to accommodate different size plugs, and each unit may include more than a single plug holder.

16 Claims, 4 Drawing Sheets

FIG. 1
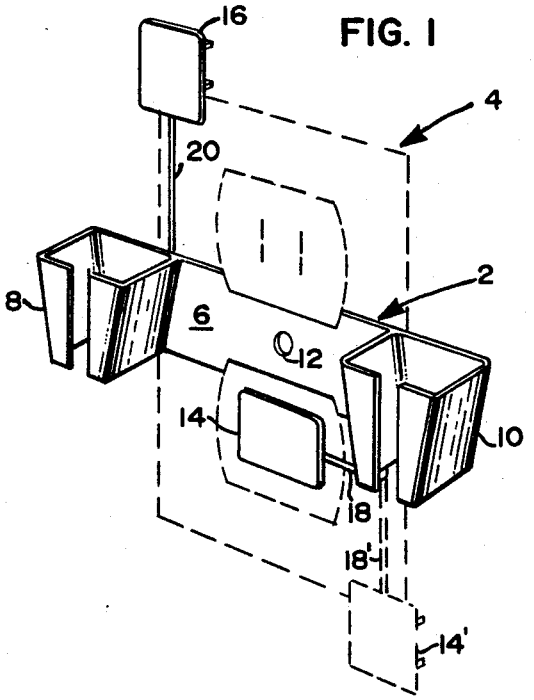
FIG. 2
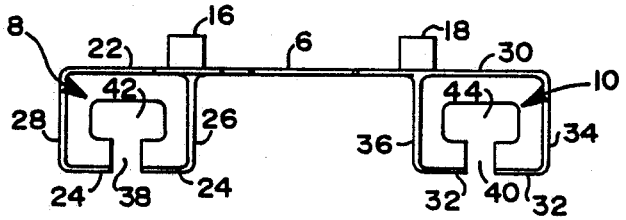
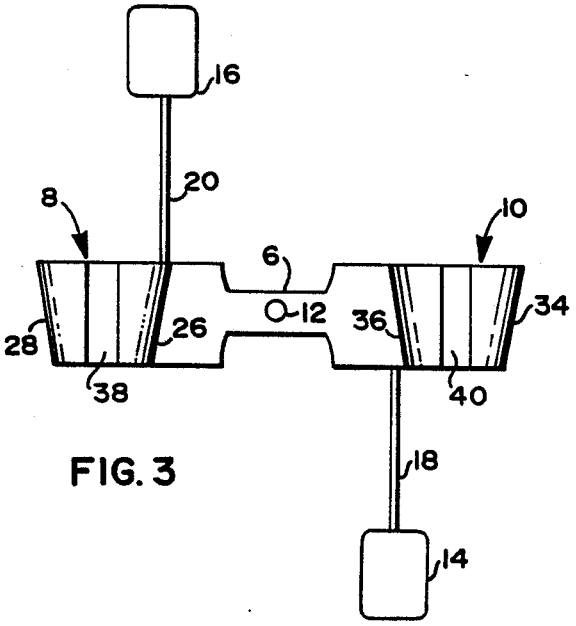
FIG. 3
FIG. 4
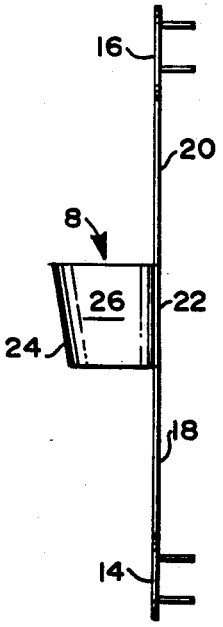

FIG. 9
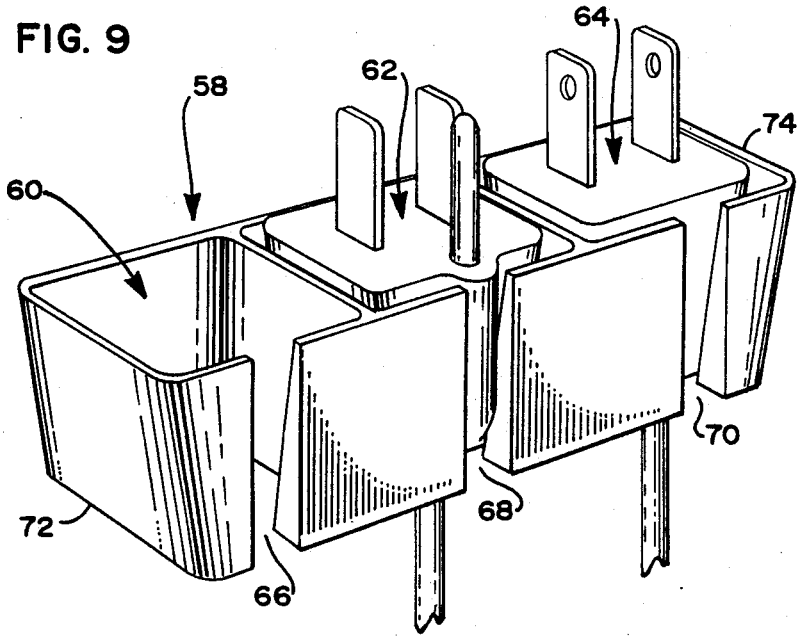
FIG. 10
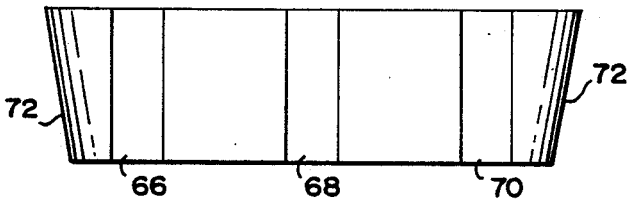
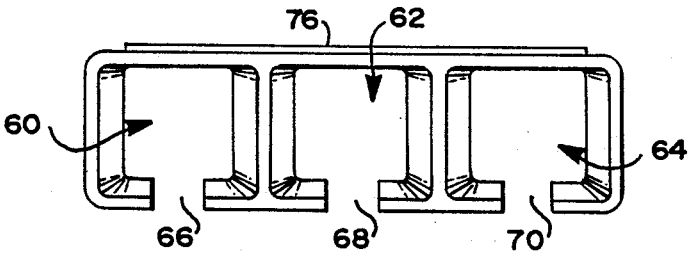
FIG. 11

ELECTRIC PLUG ORGANIZER

BACKGROUND OF THE INVENTION

The present invention relates to holders for electrical plugs and electrical cords of the type which are mounted proximate to an electrical outlet. The holders may be used to store an electrical plug after it has been removed from an outlet, and may also be used to store an electrical cord attached to the plug.

In many instances it is desirable to remove an electric plug from an electrical outlet when an electrical appliance is not in use. For example, it may be desirable to remove the plug from the outlet to prevent the potential danger of electrical fires or of electrical overloading of circuits. Unattended younger children may tend to play with the plug. Moreover, because a residence or business premise generally has only a limited number of electrical outlets at predetermined locations, it is not uncommon that the number of electrical appliances run from the outlets exceeds the number of outlets, thereby requiring one appliance to be unplugged before a different appliance may be plugged into the outlet.

When an appliance is unplugged from an outlet, it is desirable that the plug be stored close to the outlet for future use. However, merely laying the plug next to the outlet can present several dangers. People, and in particular small children, may be injured as a result of tripping over loose electrical cord. Additionally, an unused electric plug lying near an electrical outlet may pose a danger by attracting younger children who might tend to play with the plug or the outlet, possibly causing injury to themselves.

Devices for storing electrical plugs or electrical cords close to an electrical outlet are generally known to the prior art. However, the known devices each have distinct disadvantages. The following is a discussion of typical prior art devices illustrative of the state of the art:

U.S. Pat. No. 3,331,915 discloses a pair of plug holders mounted proximate to an electrical outlet. Each of the plug holders is adapted to loosely receive and store one prong from an electric plug when the electric plug is not inserted into the outlet.

U.S. Pat. No. 3,722,843 discloses an "L" shaped apertured bracket through which an electrical cord passes. The apertures are smaller than the dimensions of the plug attached to the end of the cord to prevent removal of the fixture attached to the electrical cord.

U.S. Pat. No. 4,702,709 discloses a retaining bracket or clip mounted proximate to an electrical outlet. The electrical cord may be tied around the bracket when the plug is inserted into the outlet to prevent the plug from being inadvertently disengaged from the outlet as a result of pulling forces on the end of the electrical cord remote from the plug. This patent additionally discloses a plate which is selectively slideable over the electrical outlet to shield the same when the outlet is not in use. However, the slide plate would appear to be relatively complicated and expensive because it must be precisely mounted so that openings in the plate are aligned with the outlet openings in one position but are out of alignment in a second position. Moreover, a user is required to remove a retaining bar and exert a force on a bracket to slide the plate out of alignment with the outlet openings when it is desired to cover the outlet.

U.S. Pat. No. 2,943,138 generally discloses an outwardly extending slotted bracket mounted proximate to an electrical outlet for loosely storing an electrical plug when it is not in use, or for storing an electrical cord by wrapping it around a bracket. The stored electric plug is only loosely supported from its bottom surface. Similarly, Swiss Patent No. 246,366 and Norwegian Patent No. 78,595 disclose storage devices for electrical plugs in which the plugs are loosely supported only from their underside.

U.S. Pat. No. 4,285,486 discloses a holder for an electrical cord in which the electrical plug attached to the cord loosely dangles beneath the holder. Similarly, U.S. Pat. No. 3,113,996 discloses a "J" shaped bracket extending downwardly from an electrical outlet for loosely supporting an article such as a coiled electric extension cord.

U.S. Pat. No. 2,084,953 and Des. 275,175 generally disclose electrical cord holders in the form of spring loops or retainer clips mounted proximate to an electrical outlet.

U.S. Pat. No. 4,339,045 discloses an article holder mounted close to a wall switch. The holder is adapted to store articles such as a key ring and the like.

Finally, U.S. Pat. Nos. 4,293,173 and 2,728,894 generally disclose shields or outlet protectors which are intended to be inserted into electrical outlets as safety closures when the outlets are not in use.

It is apparent from the above discussion of the prior art that the known devices for storing electrical plugs proximate to electrical outlets do not provide means for securely storing and retaining the plugs when they are not in use. The illustrative examples of the prior art disclose devices which are capable of only loosely storing and retaining electrical plugs. Additionally, none of the above discussed prior art discloses a storage holder for an electrical plug which is capable of separately and individually storing an electrical cord attached to a plug, either when the plug itself is being stored or when the plug is inserted into an electrical outlet. Furthermore, none of the prior art discloses use of a protective outlet cover mounted to a plug and cord storage holder proximate to an electrical outlet such that the protective shield may be readily inserted into an unused and exposed electrical outlet when the plug and electrical cord are stored in the holder.

It is an object of the present invention to overcome the disadvantages of the prior art discussed above. Other objects and advantages of the invention will become apparent from the following description.

SUMMARY OF THE INVENTION

In accordance with the present invention, an electric plug organizer includes a plug holder formed from a resilient material. The plug holder includes opposed front and rear walls, and opposed side walls all of which define a substantially closed structure having an open top and open bottom surface. A vertical slot is defined down one of the walls of the holder.

An electrical plug not in use may be received within the holder through either the opened top or bottom surface and may be stored therein by frictional engagement with the inner surfaces of the walls of the holder. In its normal position, the holder is dimensioned to securely receive a plug, such as a standard size two prong plug, and retain the same therein by frictional engagement. However, as a result of the resilient nature of the material forming the holder and the slot extending through one wall thereof, the holder can be expanded to retain a larger plug, such as a standard three prong plug, stored therein by frictional engagement. The holder is adapted to surround the peripheral portion of a plug to securely retain the plug in its storage position. The holder may be tapered to enhance the frictional engagement with the plug, and the upper ends of the walls of the holder provide a peripheral rim to engage a peripheral flange on a plug to more securely retain the plug within the holder. Means are provided for mounting the holder proximate to an electrical outlet, and the holder is preferably formed from an electrically insulated material.

In further embodiments of the invention, the electric plug organizer comprises a plurality of adjacent plug holders which can be of the same or different dimensions to accommodate the same or different sized plugs.

In an additional embodiment of the invention, an electrical cord storage compartment is defined adjacent to the plug holder receptacle. The electrical cord storage compartment is formed from a resilient material and has four peripheral walls, one of which may be common with one of the walls defining the adjacent plug holder compartment. The cord storage compartment has an open top and open bottom surface and is adapted to receive an electrical cord connected to the electric plug. The cord storage compartment also defines a slot extending down one of its walls to enable the compartment to expand when necessary. An electric cord may be stored in the storage compartment when the electric plug is either stored in the adjacent plug holder or inserted into an electrical outlet proximate thereto. The cord storage compartment picks up any slack in the electrical cord.

In a further embodiment of the invention, an electrically insulated outlet protective shield is mounted to the plug storage compartment or the electric cord storage compartment, as for example by a cord or an elastic band. When an electric plug is not in use and is stored within the plug storage compartment, the outlet shield may be inserted into an exposed electrical outlet. Since the outlet shield is mounted to the plug or cord storage compartment, which itself is mounted proximate to the electrical outlet, the protective outlet shield is always accessible and may be readily inserted into or removed from an electrical outlet.

The embodiments of the invention provide a convenient manner for securely storing electric plugs of the same or different dimensions in the same or adjacent storage holders mounted proximate to an electrical outlet. The invention promotes safety by encouraging removal of electric plugs from electric outlets when appliances are not in use, by eliminating slack in electric cords when appliances are both in use and not in use, and by providing outlet shields mounted proximate to an electrical outlet to encourage use of the same when the outlet is exposed.

BRIEF DESCRIPTION OF THE DRAWINGS

FIG. 1 of the drawings is a prospective view of one embodiment of an Electric Plug Organizer in accordance with the present invention mounted to an electrical outlet;

FIG. 2 is a top plan view of the embodiment illustrated by FIG. 1;

FIG. 3 is a front elevational view of the embodiment illustrated by FIG. 1;

FIG. 4 is a side elevational view of the embodiment illustrated by FIG. 1;

FIG. 9 is a prospective view of a fourth embodiment of the invention in which a plurality of plug holders are defined adjacent to one another;

FIG. 10 is a front elevational view of the embodiment illustrated by FIG. 9; and FIG. 11 is a top plan view of the embodiment illustrated by FIG. 9.

DESCRIPTION OF THE BEST MODES FOR CARRYING OUT THE INVENTION

Figure 5:
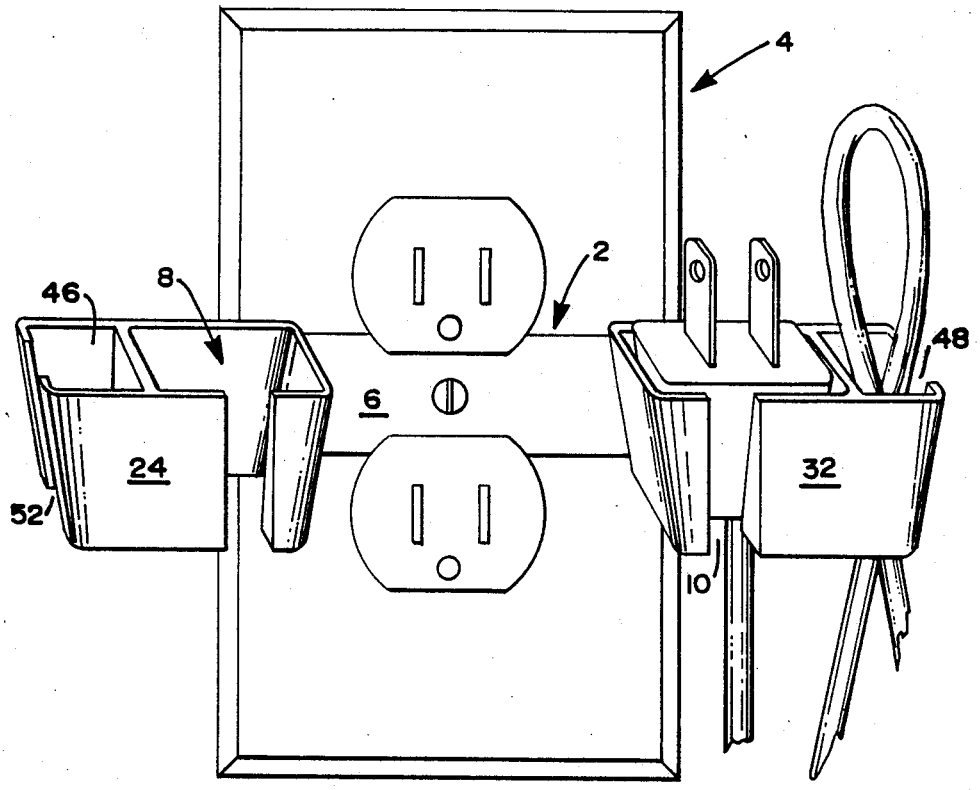
FIG. 5 is a prospective view of a second embodiment of the invention in which a plug organizer including a cord holder is mounted to an electrical outlet.

Referring first to FIGS. 1–4 of the drawing, a first embodiment of an Electric Plug Organizer in accordance with the present invention is illustrated. A plug organizer device is generally illustrated by reference numeral 2 and is shown mounted to a standard electrical outlet designated generally by reference numeral 4. The device includes a mounting plate 6 extending across the center of the electrical outlet, and two plug holders respectively designated as reference numerals 8 and 10 defined at the opposed remote ends of the mounting plate 6. A central opening 12 in the mounting plate 6 may be used to mount the plug organizer device to a standard outlet cover by a mounting screw. In the embodiment disclosed by FIG. 1, the plug holders 8 and 10 are integral with the connecting mounting plate 6.

FIG. 1 also discloses conventional outlet shields 14 and 16 respectively mounted to each of the plug holders 8 and 10 by cords 18 and 20. In FIG. 1, outlet shield 14 is shown inserted into an electrical outlet, while reference numerals 14' and 18' illustrate, in phantom, the position of the shield 14 and cord 18 when not in use.

Referring now to FIG. 2, each plug holder is formed from four adjacent walls. The plug holder 8 includes a rear wall 22, a front wall 24, and opposed side walls 26 and 28. The plug holder 10 similarly includes a rear wall 30, a front wall 32, and opposed side walls 34 and 36. As is apparent from FIGS. 1 and 2, the front walls 24 and 32 of the plug holders 8 and 10, each define a generally centered vertical slot respectively designated as reference numerals 38 and 40. The central open spaces 42 and 44 defined by the respective plug holders 8 and 10, are compartments adapted to receive and frictionally engage different electrical plugs to be stored within the plug holders. The top and bottom surfaces of each plug holder 10 are open.

FIG. 3 of the drawings illustrates a front elevational view of the embodiment of the invention disclosed by FIGS. 1 and 2. As is more clearly seen from FIG. 3, the opposed side walls 26 and 28 of the plug holder 8 and the opposed side walls 34 and 36 of the plug holder 10, each respectively, taper outwardly in a direction from bottom to top. Likewise, FIG. 4, which illustrates a left side elevational view of FIG. 1, shows that the front wall 24 of the plug holder 8 is also tapered outwardly in a direction from bottom to top. Although not shown in FIG. 4, the front wall 32 of plug holder 10 is tapered in a similar manner.

The plug organizer device disclosed in FIGS. 1–4 is preferably formed from a resilient electrically insulated material, as for example a plastic such as Valox or Noryl. The device may be formed by conventional injection molding. Cords 18 and 20 may be formed from an elastic material such as hard rubber. Preferably, the side walls of the plug holders 8 and 10 are tapered at an angle of approximately 9% while the front walls of the holders are tapered at an angle of about 5%.

Figure 6:
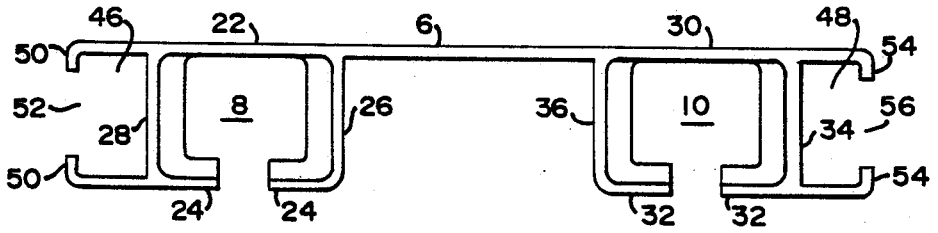
FIG. 6 is a top plan view of the embodiment illustrated by FIG. 5.

Referring now to FIGS. 5–6 of the drawings, a slightly modified embodiment of the plug organizer device of FIGS. 1–4 is illustrated. The same reference numerals have been used for corresponding elements. The basic difference between the embodiment disclosed by FIGS. 1–4 and the embodiment illustrated by FIGS. 5–6 is that in the latter embodiment of the invention, compartments 46 and 48 are defined adjacent to respective plug holder compartments 8 and 10. As illustrated by FIG. 5, the additional compartments 46 and 48 are adapted to store an electrical cord attached to a plug when the plug is stored in the plug holder. The electrical cord may, of course, also be stored within compartments 46 and 48 when the electrical plug is inserted into the outlet and is not being stored in the adjacent plug holder compartment.

The cord receptacle 46 includes a side wall 50 having a vertical slot 52, while cord receptacle 48 includes a side wall 54 having a vertical slot 56. The front walls of the cord storage compartments 46 and 48 are defined by extensions of the front walls of adjacent plug holders 8 and 10 respectively, while the rear walls of cord compartments 46 and 48 are formed from extensions of the rear walls of the plug storage compartments 8 and 10 respectively. Additionally, side wall 28 of plug holder 8 is common to adjacent cord compartment 46, while side wall 34 of plug holder 10 is common to adjacent cord compartment 48. Each cord and plug holder compartment is open on the top and bottom surface. A wound electrical cord may be received within the cord compartments 46 or 48 through the respective vertical slots 52 and 56 or through the open top or bottom surface, and retained in a storage position therein as a result of frictional engagement with the inner surfaces of the walls forming the compartment. The cord compartments 46 and 48 are formed from the same resilient material as are the adjacent plug holder compartments 8 and 10 and preferably are also electrically insulated. Although not shown in the embodiments illustrated by FIGS. 5–6, outlet shields 14 and 16 may be mounted to either or both of the combined cord and plug holders.

Figure 7:
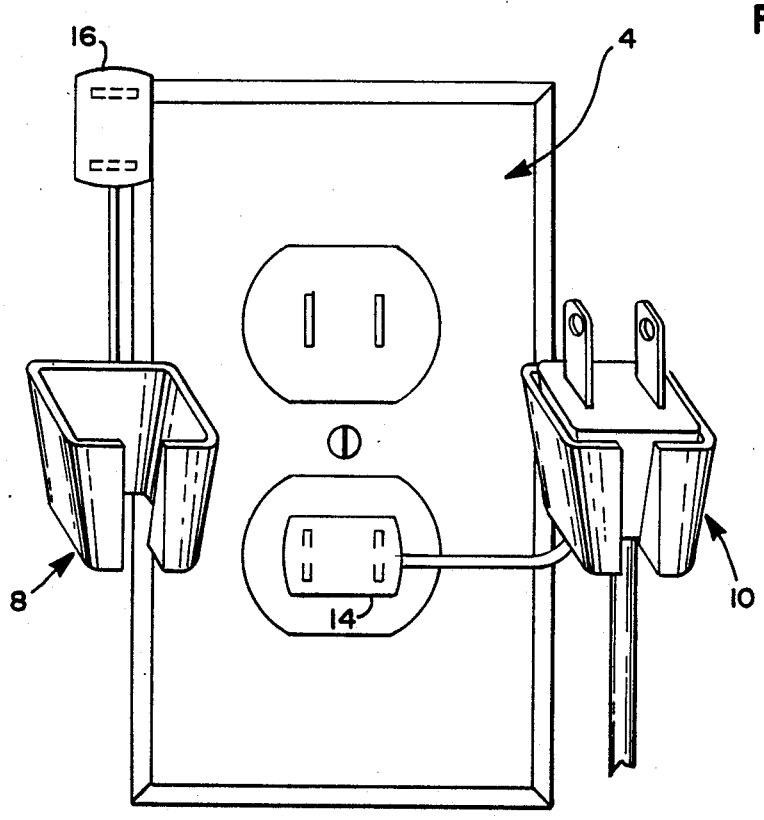
FIG. 7 illustrates a prospective view of third embodiment of the invention in which individual plug holders are mounted to different sides of an electrical outlet.
Figure 8:
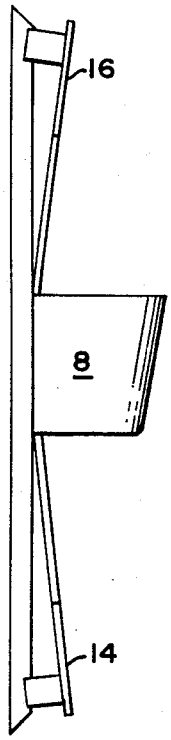
FIG. 8 is a side elevational view of the embodiment illustrated by FIG. 7.

FIGS. 7 and 8 of the drawing represent a further embodiment of the invention, similar in nature to that disclosed by FIGS. 1–6. FIG. 7 illustrates two separate plug holders, 8 and 10, which are individually mounted to an electrical outlet 4. The individual plug holders may be mounted by conventional means such as two sided tape. In this manner, the position of one holder may be adjusted without adjusting the position of the other holder. As also shown in FIGS. 7 and 8, outlet shields 14 and 16 are attached respectively to plug holders 8 and 10. As discussed with respect to the first embodiment of the invention, plug holders 8 and 10 are formed from a resilient material; and are generally outwardly tapered in a direction from bottom to top; each are defined by four walls, one of which defines a vertical slot; and each has an open top and an open bottom surface.

FIGS. 9–11 illustrate a still further embodiment of the plug organizer in accordance with present invention. A receptacle generally designated by reference numeral 58 defines three adjacent plug holder compartments 60, 62 and 64. These compartments are of the same dimension. In FIG. 9, compartment 60 is empty, compartment 62 is being employed to store a larger three prong electric plug, while compartment 64 is being employed to store a smaller standard two prong electric plug. As in the previous embodiments of the invention, the electric plug organizer 58, is formed from a resilient material which is preferably electrically insulated. The front walls of the respective compartments 60, 62 and 64, define vertical slots 66, 68 and 70 respectively. The outer side walls 72 and 74 of compartments 60 and 64 are tapered outwardly in an upwardly direction. The plugs stored within compartment 62 and 64 are held therein by frictional engagement by the inner surfaces of the resilient side walls of the respective compartments. As is evident from FIG. 9 of the drawing, each of the compartments 60, 62 and 64 is capable of receiving and storing plugs of different sectional areas or widths as a result of the resilient nature of the side walls defining the different compartments and the front slots in the compartments. Moreover, the vertical slot 68 defined on the front wall of compartment 62 is employed to accommodate the front protuberance of the larger three prong plug as illustrated by FIG. 9. Accordingly, although the compartments of the plug organizer device are of the same dimension, each compartment is capable of storing electrical plugs of the same or different dimensions.

Although not shown in FIGS. 9–11, it is possible to define cord storage compartments similar to that disclosed by FIGS. 5 and 6 adjacent to one or more of the plug storage compartment 60, 62 and 64. Likewise, outlet shields such as those disclosed by reference numbers 14 and 16 in FIGS. 1–4, may be mounted to one or more of the storage compartments 60, 62 and 64 of the device 58 as illustrated in FIGS. 9–11. As shown in FIG. 11, a strip 76 of double sided tape is affixed to the outer surface of the common rear wall of the device 58. Magnetic strips on the outer surface of the rear wall may also be used to mount the device 68 to a magnetic material such as an outlet cover. Accordingly, the device 58 may be removably mounted proximate to an electrical outlet. In the alternative, conventional mounting means such as screws may be employed to permanently mount the organizer 58 at a location close to an electrical outlet by screw mounting the rear wall to a fixed surface such as an outlet cover or a wall.

In all embodiments of the invention discussed herein, a plug holder is defined from a resilient material having peripheral walls and a slot extending through one of the walls. The plug holder is preferably electrically insulated and a plurality of adjacent plug holders of the same or different dimensions may be formed integral with each other or separate from each other. Moreover, in the preferred embodiments of the invention, a compartment for holding a wound electrical cord attached to the plug is defined adjacent to the plug holder compartment. Electrically insulated outlet covers or shields may be mounted to the plug and cord holder compartments. Accordingly, in the preferred embodiments of the invention, a single unit including one or more plug holders, one or more cord holders, and one or more electrical outlet shields may be permanently or removably mounted proximate to an electrical outlet.

In operation of each embodiment of the invention, an electric plug is received in gripping frictional engagement with the inner side walls of a plug holder by inserting the plug either upwardly or downwardly within the holder. Since the holder is formed from a resilient material, and since each holder also defines a slot through one wall, the plug holder is expandable for accommodating an electrical plug inserted therein. Once the plug is received within the plug holder, the resilient forces exerted on the outer surface of the plug by the surrounding inner surface of the plug holder tend to maintain the plug firmly and securely stored within the holder. In order to assure gripping frictional engagement between the plug and the holder, the holder is designed so that the central open space defined by the holder is slightly less than that width of the smallest plug intended to be stored within the holder. However, because the holder is formed from a resilient material, and includes a slot down one side wall, it is readily expandable to receive and store plugs of different widths such that the same size holder may selectively store both standard size two prong electric plugs and larger three prong electric plugs. Moreover, since each plug holder is defined from four adjacent connected walls forming a substantially closed compartment, the holder substantially surrounds the entire periphery of a plug stored therein to more securely hold the plug in its storage position and to provide a wider surface area for frictional engagement between the plug and the surrounding walls to more firmly retain the plug stored within the holder. The tapered design of the plug holder further tends to more securely retain a plug and prevent it from falling out of the open bottom of the holder. Since the top surface of the plug holder is open and defines a peripheral rim, this upper rim may be employed to engage a flange on the outer surface of a plug to further enhance the firm retention of a plug by a holder.

In the embodiments of the invention which provide an electrical cord storage compartment defined adjacent to the plug holder (FIGS. 5–6), a wound electrical cord is received within the cord storage compartment through a slot defined on one wall of this compartment. In the alternative, the wound cord may be received within the cord storage compartment either through the open upper surface or the open bottom surface. In either event, the cord is maintained in an stored position within the compartment as a result of frictional engagement between the cord (which in a folded position tends to expand) and the inner surfaces of the walls defining the cord storage compartment. The cord may be stored when the plug attached to the cord is stored in an adjacent compartment. In the alternative, the cord may be stored for the purpose of eliminating slack even when the plug is received within the electrical outlet.

All embodiments of the invention may employ one or more insulated outlet shields (as for example shields 14 and 16 shown in FIG. 1) mounted to either the plug storage compartment, the cord storage compartment or both. When plugs are stored within the plug holder and not in use in an electrical outlet, an outlet shield may be inserted into an unused outlet for safety purposes. When a covered outlet is needed for use, the outlet shield is merely removed. Since the outlet shield is permanently affixed to the plug holder, it is automatically stored close to the outlet, thereby encouraging its use.

The embodiments of the invention discussed herein illustrate that the plug organizer device may be permanently mounted proximate to an electrical outlet by conventional mounting means (see FIG. 1), or removably mounted proximate to an electrical outlet by employing conventional means such as two sided tape (see FIG. 11). Moreover, plug holders may be mounted in joined pairs (FIGS. 1 and 5), may be mounted as a single unit comprising a plurality of adjacent compartments (FIG. 9), or may be individually mounted in single units (FIG. 7). Although the preferred embodiments of the invention illustrate plug holders mounted so that the plugs stored therein are vertically oriented, it is within the scope of the invention to mount the plug holders so that plugs stored therein are also oriented horizontally. The only requirement concerning the mounting of the plug holder is that it be mounted on or close to an electrical outlet so that it may be conveniently used together with the outlet.

It is apparent that the embodiments of the present invention provide numerous safety features. The plug holders encourage users to remove plugs from outlets when not in use, and the plug holders are adapted to securely and conveniently store different size plugs within the same holder. Providing outlet protective shields mounted on the plug holders, tends to encourage the use of these protective devices when plugs are removed from outlets. Because the outlet shields are permanently mounted to the plug holders, which themselves are mounted proximate to an electrical outlet, the protective shields are readily available and conveniently accessible for use near the electrical outlet. Additionally, the cord storage compartments defined adjacent to the plug holder may be readily used to eliminate or reduce slack in electrical cords which might otherwise result in injury.

In the embodiments of the invention in which the electric plug organizer provides more than a single plug holder, the different holders or compartments are shown as being of the same dimensions. As discussed above, since each holder is defined from a resilient material and is also expandable as a result of the slot defined therein, one holder may accommodate many different sized plugs. However, it is also within the scope of this invention to provide a plurality of plug holders each being of different dimensions from each other. In any event, the holders are designed to substantially surround the periphery of a plug to securely retain the plug in the holder.

The electric plug organizers illustrated by the preferred embodiments of the invention may be integrally formed from a resilient material by conventional means such as blow molding. Preferably, the resilient material will also be electrically insulated. Exemplary materials from which the plug organizer may be formed are plastics such Valox or Noryl, or other suitable materials which are known to those skilled in the art.

Other modifications and advantages of the plug organizer device within the scope of the invention will become apparent to those skilled in the art. Accordingly, the above description of the preferred embodiments of the invention, is intended to be illustrative only and not restrictive of the scope of the invention, that scope being defined by the following claims and all equivalents thereto.

I claim:

1. A device for storing an electrical plug comprising:

at least one storage compartment including a front wall, a rear wall and a pair of opposed sidewalls defining a receptacle having an open top and an open bottom, said at least one storage compartment being formed from a resilient material, said at least one storage compartment adapted to surround and engage the periphery of an electrical plug receivable therein, at least one slot defined in one of said walls, and means for mounting said plug storage compartment proximate to an electrical outlet.

2. The device of claim 2 wherein said plug storage compartment is formed from an electrically insulated material.

3. The device of claim 1 wherein said at least one slot cooperates with said resilient material forming said plug storage compartment such that said plug storage compartment is expandable to receive electrical plugs of different sizes.

4. The device of claim 1 wherein said plug storage compartment is tapered outwardly in a direction from said opened bottom to said opened top.

5. A device for storing an electrical plug comprising:

a plurality of plug storage compartments, each of said compartments including a front wall, a rear wall and a pair of opposed sidewalls defining a receptacle having an open top and an open bottom, at least one slot defined in one of said walls of each of said compartments, and means for mounting said plurality of plug storage compartments proximate to an electrical outlet.

6. The device of claim 5 wherein said plurality of plug storage compartments are defined adjacent to each other, each of said adjacent plug storage compartments having one common sidewall.

7. The device of claim 5 wherein said plurality of plug storage compartments are integrally joined to each other by a connecting member.

8. The device of claim 5 wherein each of said plurality of plug storage compartments is of the same dimensions.

9. A device for storing an electrical plug comprising:

at least one plug storage compartment including a front wall, a rear wall and a pair of opposed sidewalls defining a receptacle having an open top and an open bottom, at least one slot defined in one of said walls, and means for mounting said plug storage compartment proximate to an electrical outlet, said device further including at least one electrical cord storage compartment defined proximate to said at least one plug storage compartment, said electrical cord storage compartment including a front wall, a rear wall and a pair of opposed sidewalls defining a receptacle having an open top and an open bottom.

10. The device of claim 9 wherein said at least one electrical cord storage compartment is defined adjacent to said at least one plug storage compartment, said plug and said electrical cord storage compartments being formed from resilient material, said electrical cord storage compartment defining a slot in at least one of its said walls.

11. A device for storing an electrical plug comprising:

at least one plug storage compartment including a front wall, a rear wall and a pair of opposed sidewalls defining a receptacle having an open top and an open bottom, at least one slot defined in one of said walls, and means for mounting said plug storage compartment proximate to an electrical outlet, said device further including an electrical outlet protective shield mounted to said device, said electrical outlet protective shield being insertable into an exposed electric outlet proximate to the position at which said plug storage compartment is mounted.

12. The device of claim 11 wherein said electrical outlet protective shield is mounted to said device by a cord.

13. A device for storing an electrical plug or an electrical cord, said device comprising:

at least one plug storage compartment including a front wall, a rear wall, and a pair of opposed sidewalls defining a first receptacle having an open top and an open bottom; at least one of said walls of said plug storage compartment defining a slot therein, at least one electrical cord storage compartment including a front wall, a rear wall and a pair of opposed sidewalls defining a second receptacle having an open top and an open bottom; at least one of said walls of said electrical cord storage compartment defining a slot therein, at least one electrical outlet protective shield mounted to at least one of said first and second receptacles, said electrical outlet protective shield adapted to being selectively inserted into an exposed electrical outlet, and means for mounting said first and second receptacles proximate to an electrical outlet.

14. The device of claim 13 wherein said at least one plug storage compartment and said at least one electrical cord storage compartment are formed from resilient material.

15. The device of claim 14 wherein said at least one plug storage compartment and said at least one electrical cord storage compartment are adjacent to each other, said adjacent compartments having a common sidewall.

16. A device for storing an electrical plug comprising a receptacle having at least one wall defining a substantially closed peripheral structure having an open top and an open bottom, said at least one wall defining a slot therein, said closed structure adapted to receive and retain an electrical plug therein by frictional engagement thereof against an inner surface of said at least one wall, said receptacle being formed from a resilient material, said receptacle being expandable as a result of cooperation between said resilient material and said slot defined in said receptacle.

* * * * *

UNITED STATES PATENT AND TRADEMARK OFFICE

CERTIFICATE OF CORRECTION

PATENT NO. : 4,921,444

DATED : May 1, 1990

INVENTOR(S) : Christopher C. Cama

It is certified that error appears in the above-identified patent and that said Letters Patent is hereby corrected as shown below:

Claim 2, Line 1 (Column 9, Line 9):

Delete "claim 2" and substitute - -claim 1- -.

Signed and Sealed this

Ninth Day of July, 1991

*Attest:*

*Attesting Officer*

HARRY F. MANBECK, JR.

*Commissioner of Patents and Trademarks*